US007137374B1

(12) United States Patent
Ballard

(10) Patent No.: US 7,137,374 B1
(45) Date of Patent: Nov. 21, 2006

(54) ADJUSTABLE HYDRAULIC VALVE LIFTER

(76) Inventor: Mike Wayne Ballard, 404 Valley Trail Dr., Weatherford, TX (US) 76087

( * ) Notice: Subject to any disclaimer, the term of this patent is extended or adjusted under 35 U.S.C. 154(b) by 0 days.

(21) Appl. No.: 11/354,745

(22) Filed: Feb. 15, 2006

(51) Int. Cl.
*F01L 1/14* (2006.01)

(52) U.S. Cl. ..... 123/90.59; 123/90.55; 123/90.48

(58) Field of Classification Search ..... 123/90.59, 123/90.45, 90.55, 90.46, 90.57, 90.48
See application file for complete search history.

(56) References Cited

U.S. PATENT DOCUMENTS

| | | | | |
|---|---|---|---|---|
| 2,803,231 | A | 8/1957 | Skinner | |
| 3,742,921 | A | 7/1973 | Rendine | |
| 3,921,609 | A | 11/1975 | Rhoads | |
| 4,218,995 | A | 8/1980 | Aoyama | |
| 4,324,210 | A | 4/1982 | Aoyama | |
| 4,407,241 | A | 10/1983 | Butler et al. | |
| 4,524,731 | A | 6/1985 | Rhoads | |
| 4,601,268 | A | 7/1986 | Rhoads | |
| 4,602,597 | A | 7/1986 | Rhoads | |
| 4,696,265 | A | 9/1987 | Nohira | |
| 4,741,298 | A | 5/1988 | Rhoads | |
| 4,889,085 | A | 12/1989 | Yagi et al. | |
| 4,977,867 | A | 12/1990 | Rhoads | |
| 5,623,898 | A | 4/1997 | Bruton | |
| 2003/0051689 | A1* | 3/2003 | Schnell | 123/90.59 |

* cited by examiner

*Primary Examiner*—Thomas Denion
*Assistant Examiner*—Zelalem Eshete
(74) *Attorney, Agent, or Firm*—Eric Karich

(57) ABSTRACT

An adjustable hydraulic valve lifter has a lifter body and an internal cylindrical body. The lifter body has a first longitudinally cylindrical internal bore and a first substantially closed lower end, and the internal cylindrical body is axially slideable and rotatable within the first longitudinally internal bore, forming a first oil chamber. A first spring is positioned to bias the internal cylindrical body away from the lifter body. A first oil flow path permits the flow of oil into the first oil chamber through a first check valve. An oil outlet in the lifter body adjacent the first substantially closed lower end allows oil to escape from the first oil chamber as controlled by an oil control recess in an outer surface of the internal cylindrical body.

15 Claims, 3 Drawing Sheets

ADJUSTABLE HYDRAULIC VALVE LIFTER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to valve lifters, and more particularly to an adjustable hydraulic valve lifter.

2. Description of Related Art

The following art defines the present state of this field:

Aoyama, U.S. Pat. No. 4,218,995, teaches a hydraulic valve lifter mechanism that includes a second chamber in a manner similar to the present invention. Oil in the second chamber is regulated with a piston and an oil-reserving chamber. Under the right circumstances, the oil-reserving chamber will allow oil to escape from the second chamber. When oil pressure applied to the first chamber is decreased as the engine speed lowers, the plunger moves toward the first chamber to allow the second chamber to communicate with an oil-reserving chamber through a hole. The amount of valve lift in a medium oil pressure range depends on the degree of closing of this hole by the plunger which is moved together with the cylinder head by the rotating cam.

Butler, et al., U.S. Pat. No. 4,407,241, teaches an expandable hydraulic tappet having a variable exit valve for use in an internal combustion engine to selectively vary timing by altering the effective profile of a camshaft. The tappet expands to extend the drive train between the camshaft and a camshaft operated mechanism by enlarging and filling an internal hydraulic chamber with a non-compressible hydraulic fluid via an inlet port and inlet valve. The fluid is retained in the tappet chamber until a predetermined pressure is attained, when an exit valve opens to exit the pressurized fluid from the chamber at a predetermined rate. The exit valve (94) preferably includes a bore having a predetermined (stepped) configuration to provide one or more exit flow rates and also dampen valve operation. An exit valve control means responds to the pressure within the hydraulic chamber to open and close the exit valve and vary the flow rates as desired.

R. C. Shunta, et al., U.S. Pat. No. 3,385,274, teaches a push rod and rocker mechanism having a variable stroke hydraulic tappet interposed between the push rod and cam. The tappet has a plunger drivably abutting the push rod and drivable in turn by a piston-like inner member by resting on a column of hydraulic fluid contained in an outer cylinder like member which drivably engages the cam. The hydraulic fluid is supplied under adjustably controlled pressure from a pump to a port in the outer member which is open only between lift strokes of the tappet, i.e. during the dwell and lower portions of the cam lift cycle.

Other similar examples are shown in the following references: Yagi, et al., U.S. Pat. No. 4,889,085 (valve operating device), Rhoads, U.S. Pat. No. 4,741,298 (rollerized timing valve lifter), Aoyama, U.S. Pat. No. 4,324,210, Rhoads, U.S. Pat. No. 4,524,731, Rhoads, U.S. Pat. No. 4,602,597, Bruton, U.S. Pat. No. 5,623,898, Rendine, U.S. Pat. No. 3,724,921, B. C. Skinner, U.S. Pat. No. 2,803,231, Rhoads, U.S. Pat. No. 4,601,268, and Rhoads, U.S. Pat. No. 4,977,867.

The above-described references are hereby incorporated by reference in full.

The prior art teaches hydraulic valve lifters that are to some degree adjustable. However, the prior art does not teach an adjustable hydraulic valve lifter that can be continuously adjusted during operation to accommodate various different operating conditions using the mechanism described herein. The present invention fulfills these needs and provides further related advantages as described in the following summary.

SUMMARY OF THE INVENTION

The present invention teaches certain benefits in construction and use which give rise to the objectives described below.

The present invention provides an adjustable hydraulic valve lifter comprising a lifter body and an internal cylindrical body. The lifter body has a first longitudinally cylindrical internal bore and a first substantially closed lower end. The internal cylindrical body is axially slideable and rotatable within the first longitudinally internal bore of the lifter body. A first oil chamber is formed between the internal cylindrical body and the first substantially closed lower end of the lifter body. A first spring is positioned between the internal cylindrical body and the lifter body, the first spring functioning to bias the internal cylindrical body away from the lifter body. A first oil flow path permits the flow of oil into the first oil chamber through a first check valve. An oil outlet in the lifter body adjacent the first substantially closed lower end allows oil to escape from the first oil chamber. An oil control recess in an outer surface of the internal cylindrical body has an angled edge that functions to adjust the axial distance from the outer surface of the internal cylindrical body to the oil outlet when the internal cylindrical body is rotated with respect to the lifter body.

A primary objective of the present invention is to provide an adjustable hydraulic valve lifter having advantages not taught by the prior art.

Another objective is to provide an adjustable hydraulic valve lifter, and that can be continuously adjusted during operation to accommodate various different operating conditions.

Another objective is to provide an adjustable hydraulic valve lifter that enables the operation of the valve, and thus the operation of the cylinder, to be precisely controlled, from an ordinary operating mode wherein the valve opens for the maximum period of time, to a shortened operating mode wherein the valve opens for a shortened period of time, to a mode wherein the operation of the cylinder is completely stopped by maintaining the valve in a closed position.

A further objective is to provide an adjustable hydraulic valve lifter that is simple and inexpensive to construct and operate, and adaptable to existing engine designs.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
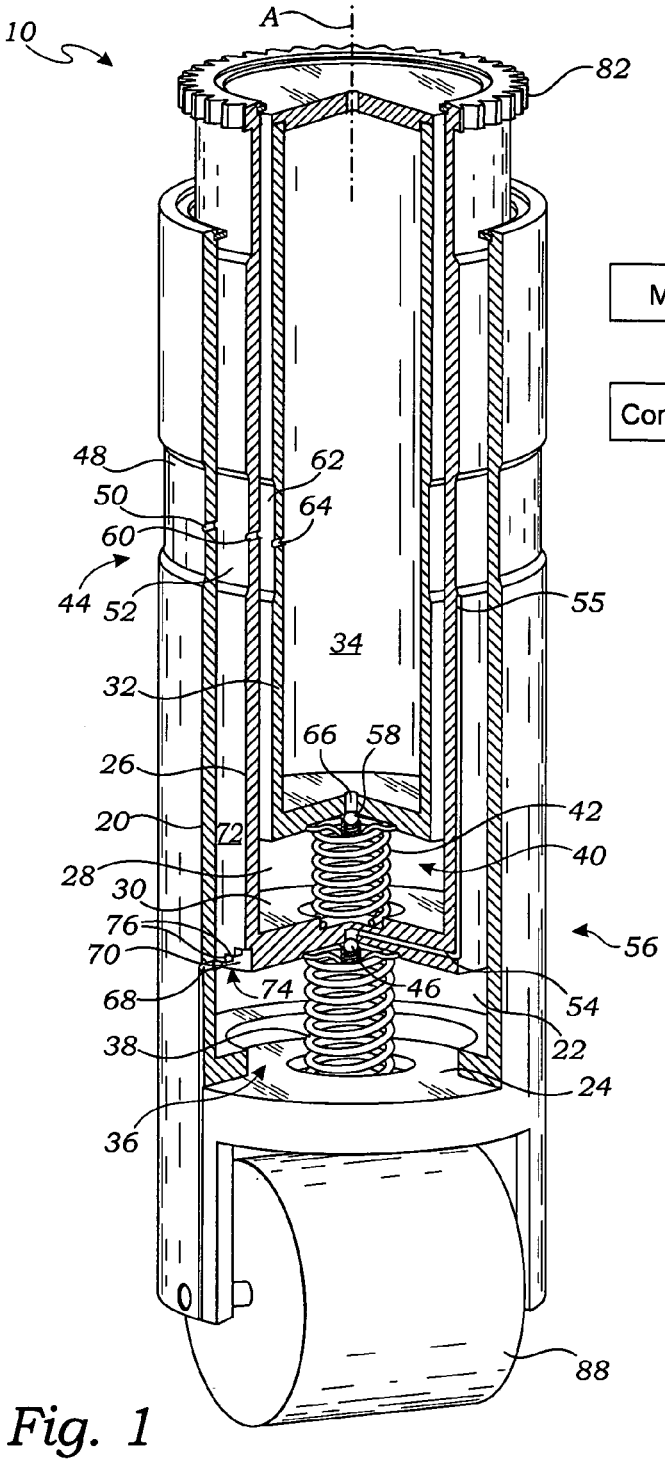
FIG. 1 is an perspective view of an adjustable hydraulic valve lifter according to a preferred embodiment of the present invention, the adjustable hydraulic valve lifter being illustrated partially broken away to reveal the internal structures of the adjustable hydraulic valve lifter.

The above-described drawing figures illustrate the invention, an adjustable hydraulic valve lifter 10 for a valve of a cylinder head of an engine.

The adjustable hydraulic valve lifter 10 may be adjusted to provide controlled lift of a rod 12 in response to the rotation of a timing cam 14. The up-and-down movement of the rod 12 ultimately controls the opening and closing of a valve (not shown) relative to its seat on a cylinder head (not shown). The movement of the rod 12 can be adjusted by controlling the characteristics of the adjustable hydraulic valve lifter 10, which enables dynamic control over the valve in the cylinder head during operation of the engine. The adjustable hydraulic valve lifter 10 may be adjusted to open the valve for a maximum duration, a shortened duration, or even complete inactivation of the valve and hence inactivation of the cylinder head of the engine.

Briefly stated, the adjustable hydraulic valve lifter 10 includes a lifter body 20, an internal cylindrical body 26, and an upper plunger 32. Rotation of the internal cylindrical body 26 with respect to the lifter body 20 functions to alter the amount of lift provided by the adjustable hydraulic valve lifter 10. Since the general construction of the rod 12, the valve, and the cylinder head are well known in the art, they are not described in greater detail herein. Furthermore, while we describe one form of engine, the general construction of the adjustable hydraulic valve lifter 10 may be adapted to many forms of engines, in particular overhead cam engines, and any other form of engine that uses a valve lifter, and such alternative arrangements should be considered within the scope of the claimed invention.

As shown in FIG. 1, the lifter body 20 is preferably cylindrical in shape, and is generally similar in construction to prior art lifters. The lifter body 20 has a first longitudinally cylindrical internal bore 22 and a first substantially closed lower end 24. The lifter body 20 includes further structures to facilitate movement of oil through the lifter body 20, as described in greater detail below.

The internal cylindrical body 26 is axially slideable and rotatable within the first longitudinally cylindrical internal bore 22 of the lifter body 20. Generally similar to the lifter body 20, the internal cylindrical body 26 includes a second longitudinally cylindrical internal bore 28 and a second substantially closed lower end 30.

The upper plunger 32 is preferably generally cylindrical in shape, and is adapted to be axially slideable within the second longitudinally cylindrical internal bore 28 of the internal cylindrical body 26. The upper plunger 32 also preferably includes an oil reservoir 34, described in greater detail below.

When the lifter body 20, the internal cylindrical body 26, and the upper plunger 32 are assembled, they form a first oil chamber 36 for controlling the movement of the internal cylindrical body 26 with respect to the lifter body 20, and a second oil chamber 40 for controlling movement of the upper plunger 32 with respect to the internal cylindrical body 26.

The first oil chamber 36 is formed between the internal cylindrical body 26 and the first substantially closed lower end 24 of the lifter body 20. A first spring 38 is positioned between the internal cylindrical body 26 and the lifter body 20, and functions to bias the internal cylindrical body 26 away from the lifter body 20. After the first spring 38 functions to open the first oil chamber 36, oil in the first oil chamber 36 functions to keep the first oil chamber 36 from collapsing under external pressure, except to the extent that oil escapes from the first oil chamber 36. The control over oil escaping from the first oil chamber 36 is central to the present invention, and is described in greater detail below.

Similar to the first oil chamber 36, the second oil chamber 40 is formed between the upper plunger 32 and the second substantially closed lower end 30 of the internal cylindrical body 26.

A second spring 42 is positioned between the upper plunger 32 and the internal cylindrical body 26. As with the first spring 38, the second spring 42 biases the upper plunger 32 away from the internal cylindrical body 26, and oil in the second oil chamber 40 keeps the second oil chamber 40 from collapsing.

It is preferred that the first spring 38 be substantially stronger than the second spring 42 to ensure that the internal cylindrical body 26 returns to the fully raised position with respect to the lifter body 20 at the end of each cycle of collapse.

A first oil flow path 44 permits the flow of oil into the first oil chamber 36 through a first check valve 46. The first oil flow path 44 preferably comprises several elements that together function to enable the proper flow of oil. The lifter body 20 preferably includes a first annular oil passage recess 48 around the lifter body 20. A first oil flow aperture 50 is preferably positioned through the first annular oil passage recess 48 of the lifter body 20. Similarly, the internal cylindrical body 26 preferably includes a second annular oil passage recess 52, and the first oil flow aperture 50 is in fluid communication with the second annular oil passage recess 52. Finally, an oil flow conduit 54 connects the second annular oil passage recess 52 with the first oil chamber 36. The oil flow conduit 54 may include a groove 55 that operably connects the oil flow conduit 54 with the second annular oil passage recess 52. The first check valve 46 is operably positioned across the oil flow conduit 54, to enable oil to flow into the first oil chamber 36, but not back.

A second oil flow path 56 permits the flow of oil into the second oil chamber 40 through a second check valve 58. The second oil flow path 56 preferably comprises several elements that together function to enable the proper flow of oil. Some of the components of the first oil flow path 44 may be used for both the first and second flow paths 44 and 56. In the preferred embodiment, the second oil flow path 56 comprises the first annular oil passage recess 48, the first oil flow aperture 50, and the second annular oil passage recess 52, described above. The second oil flow path 56 further includes a second oil flow aperture 60 through the second annular oil passage recess 52 of the internal cylindrical body 26. The upper plunger 32 further includes a third annular oil passage recess 62, and the second oil flow aperture 60 is in fluid communication with the third annular oil passage recess 62. A third oil flow aperture 64 through the third annular oil passage recess 62 of the upper plunger 32 communicates with the oil reservoir 34 within the upper plunger 32. Finally, an oil inlet aperture 66 through the upper plunger 32 communicates with the second oil chamber 40. The second check valve 58 is operably positioned across the oil inlet aperture 66.

Both the first and second oil flow paths 56 may be modified by those skilled in the art to provide oil as required to the first and second oil chambers 40. Each element or group of elements may be modified or replaced with a similar or equivalent element, as long as the oil is provided as operatively shown, and such alternatives should be considered within the scope of the present invention.

Critical to the invention, an oil outlet 68 is provided in the lifter body 20, preferably adjacent the first substantially closed lower end 24. The oil outlet 68 allows the controlled escape of oil from the first oil chamber 36, as described below.

Figure 5:
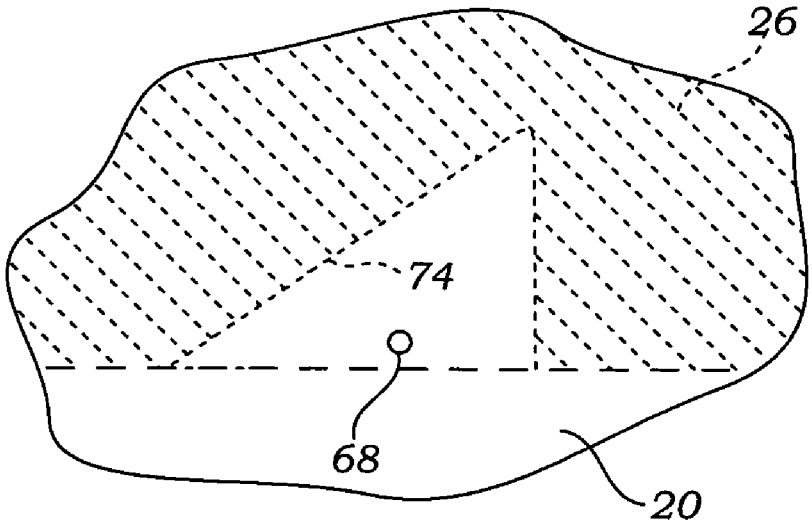
FIG. 5 is a side elevational view of the oil control recess, similar to FIGS. 3A–3D, wherein the oil control recess has an angled edge that is smooth.

Control over the flow of oil through the oil outlet 68 is provided by an oil control recess 70 in an outer surface 72 of the internal cylindrical body 26. The oil control recess 70 has an edge 74. The edge 74 is preferably angled with respect to the axis A of the lifter body 20 and functions to adjust the axial distance from the outer surface 72 of the internal cylindrical body 26 to the oil outlet 68 when the internal cylindrical body 26 is rotated with respect to the lifter body 20. As shown in FIGS. 3A–3D, the angled edge 74 of the oil control recess 70 may include a plurality of steps 76, one of the plurality of steps 76 corresponding with various positions, described in greater detail below. In an alternative embodiment, as shown in FIG. 5, the angled edge 74 may be smooth. These details are described in greater detail below.

Figure 2:
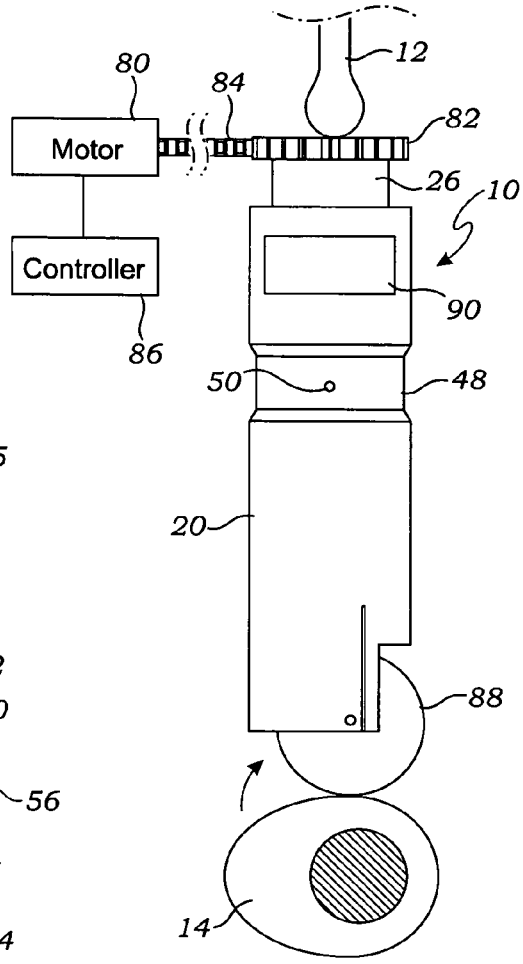
FIG. 2 is a side elevational view thereof.

In the preferred embodiment, as shown in FIG. 2, the adjustable hydraulic valve lifter 10 further comprises a motor 80 for rotating internal cylindrical body 26 with respect to the lifter body 20. In this embodiment, a pinion 82 is preferably formed in an upper portion of the internal cylindrical body 26. A rack 84 operably attached to the motor 80 operably engages the pinion 82 of the internal cylindrical body 26, enabling the motor 80 to operably control the rotation of the internal cylindrical body 26 through the rack 84 and the pinion 82. Obviously, while this single embodiment represents one way of controlling the rotation of the adjustable hydraulic valve lifter 10, alternative mechanisms may also be used or adapted by those skilled in the art, and such alternatives should be considered within the scope of the claimed invention.

As shown in FIG. 2, the lifter body 20 preferably includes an indented portion 90 that is adapted to engage a collar (not shown) or similar structure, to prevent the lifter body 20 from rotating. Such a structure is usually used in the prior art to prevent rotation of a roller with respect to the timing cam; and in the present invention, the indented portion 90 serves the additional purpose of preventing the lifter body 20 from rotating along with the internal cylindrical body 26. The indented portion 90 is hereby defined to include any form of dent, ridge, or other form of locking element operative in the manner described to control rotation of the lifter body 20. The indented portion 90 feature should be included in the adjustable hydraulic valve lifter 10 of the present invention regardless of whether the adjustable hydraulic valve lifter 10 includes the roller 88 shown in the present embodiment.

Figure 3A:
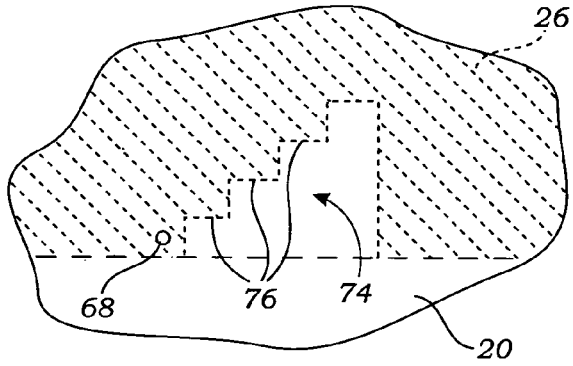
FIG. 3A is a side elevational view of an oil outlet of the adjustable hydraulic valve lifter when an oil control recess is in a closed position.
Figure 3B:
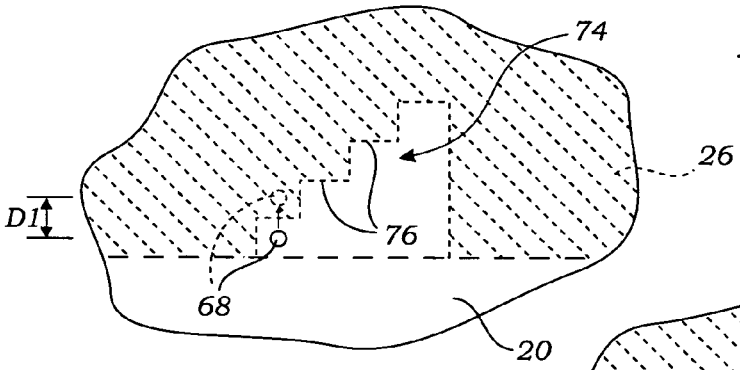
FIG. 3B is a side elevational view thereof when the oil control recess is in a first position.
Figure 3C:
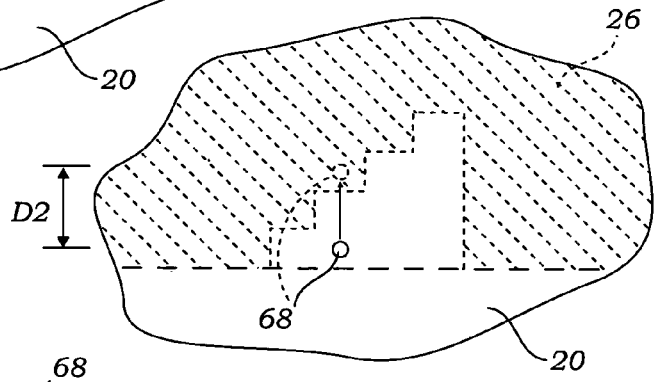
FIG. 3C is a side elevational view thereof when the oil control recess is in a second position.
Figure 3D:
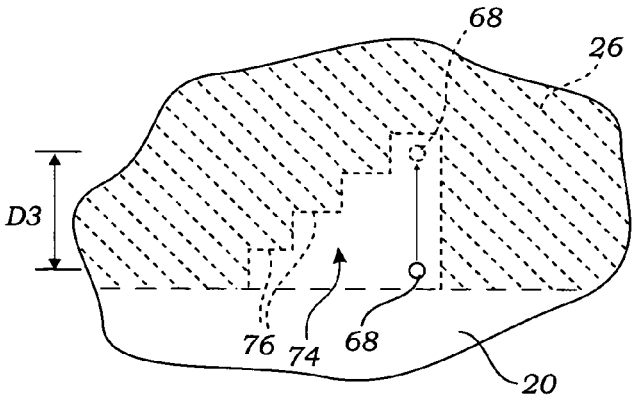
FIG. 3D is a side elevational view thereof when the oil control recess is in an open position.
Figure 4:
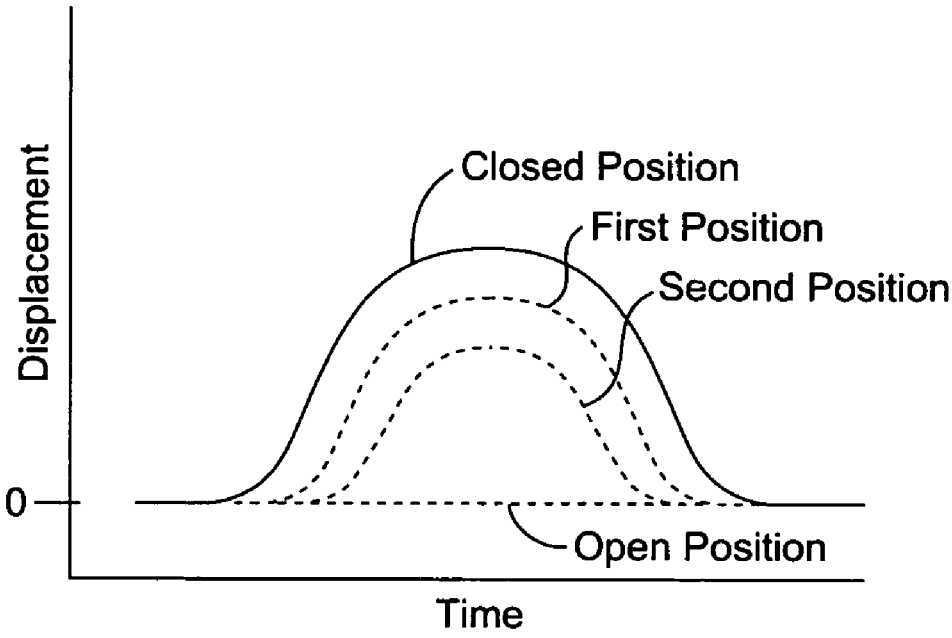
FIG. 4 is a graph illustrating push rod and proportionately valve displacement as a function of time when the oil control recess is in the closed, first, second, and open positions.

The movement of the oil control recess 70 with respect to the oil outlet 68 is best shown in FIGS. 3A–3D, which illustrate the rotation of the internal cylindrical body 26 between a closed position, shown in FIG. 3A, and a fully open position, shown in FIG. 3D. As shown in FIG. 3A, in the closed position the outer surface 72 of the internal cylindrical body 26 covers the oil outlet 68. This prevents oil from escaping through the oil outlet 68, and thereby keeps the first oil chamber 36 full of oil and provides the maximum movement of the rod 12. As shown in FIG. 4, the closed position provides the maximum displacement of the rod 12 and thereby provides the longest valve opening time.

As shown in FIG. 3B, in the first position the outer surface 72 of the internal cylindrical body 26 initially does not cover the oil outlet 68, but does cover the oil outlet 68 once the internal cylindrical body 26 has moved axially a first distance D1. This structure causes the adjustable hydraulic valve lifter 10 to collapse the first distance D1 while oil is able to escape from the oil outlet 68, and then to cease collapsing and lift the rod 12. As shown in FIG. 4, this results in a smaller displacement of the rod 12 and a shorter valve opening time.

As shown in FIG. 3C, in the second position the outer surface 72 of the internal cylindrical body 26 initially does not cover the oil outlet 68, but does cover the oil outlet 68 once the internal cylindrical body 26 has moved axially a second distance D2. This structure causes the adjustable hydraulic valve lifter 10 to collapse the second distance D2 while oil is able to escape from the oil outlet 68, and then to cease collapsing and lift the rod 12. As shown in FIG. 4, this results in an even smaller displacement of the rod 12 and an even shorter valve opening time. The second distance D2 is greater than the first distance D1. While two middle positions with two distances are illustrated and described, obviously any number of positions could be established, depending upon how finely the designer wants to control the engine.

As shown in FIG. 3D, there may also be an open position wherein the outer surface 72 never covers the oil outlet 68. In the open position, the third distance D3 is great enough to allow the complete collapse of the first oil chamber 36 when pressed by the timing cam 14, thereby leaving the valve closed and the piston inoperative. This effect is illustrated in FIG. 4.

Obviously, there may be many, or even infinite, positions between the open and closed positions. In the embodiment wherein the angled edge 74 of the oil control recess 70 includes the plurality of steps 76, each of the steps is associated with one of the defined positions. In this embodiment, the motor 80 is preferably a stepper motor 80 that turns the internal cylindrical body 26 enough to move from one step to another. The benefit of this embodiment is that calibration of the adjustable hydraulic valve lifter 10 is easier.

In the other embodiment, shown in FIG. 5, the angled edge 74 is smooth. In this embodiment, the controller 86 (shown in FIG. 2) may be used to control the movement of the motor 80 to the proper location, allowing precise control over the characteristics of the adjustable hydraulic valve lifter 10.

As shown in FIGS. 1 and 2, the adjustable hydraulic valve lifter 10 may include a roller 88 rotatably mounted on the lifter body 20 adjacent the substantially closed lower end, as shown. In alternative embodiments, the roller 88 may be omitted, or replaced with another similar or equivalent mechanism, and any such mechanism known in the art should be considered within the scope of the invention as claimed.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An adjustable hydraulic valve lifter comprising:

a lifter body having a first longitudinally cylindrical internal bore;

an internal cylindrical body axially slideable and rotatable within the first longitudinally internal bore of the lifter body;

a first oil chamber formed between the internal cylindrical body and the lifter body;

a first oil flow path permitting the flow of oil into the first oil chamber;

an oil outlet in the lifter body allowing oil to escape from the first oil chamber; and an oil control recess in an outer surface of the internal cylindrical body, the oil control recess that functions to adjust the axial distance from the outer surface of the internal cylindrical body to the oil outlet when the internal cylindrical body is rotated with respect to the lifter body.

2. The adjustable hydraulic valve lifter of claim 1, further comprising a motor for rotating the internal cylindrical body with respect to the lifter body.

3. The adjustable hydraulic valve lifter of claim 2, further comprising a controller for controlling the motor.

4. An adjustable hydraulic valve lifter comprising:

a lifter body having a first longitudinally cylindrical internal bore and a first substantially closed lower end;

an internal cylindrical body axially slideable and rotatable within the first longitudinally internal bore of the lifter body;

a first oil chamber formed between the internal cylindrical body and the first substantially closed lower end of the lifter body;

a first spring positioned between the internal cylindrical body and the lifter body, the first spring biasing the internal cylindrical body away from the lifter body;

a first oil flow path permitting the flow of oil into the first oil chamber through a first check valve;

an oil outlet in the lifter body adjacent the first substantially closed lower end allowing oil to escape from the first oil chamber; and an oil control recess in an outer surface of the internal cylindrical body, the oil control recess having an angled edge that functions to adjust the axial distance from the outer surface of the internal cylindrical body to the oil outlet when the internal cylindrical body is rotated with respect to the lifter body.

5. The adjustable hydraulic valve lifter of claim 4, further comprising a motor for rotating the internal cylindrical body with respect to the lifter body.

6. The adjustable hydraulic valve lifter of claim 5, further comprising a controller for controlling the motor.

7. An adjustable hydraulic valve lifter comprising:

a lifter body having a first longitudinally cylindrical internal bore and a first substantially closed lower end;

an internal cylindrical body axially slideable and rotatable within the first longitudinally internal bore of the lifter body, the internal cylindrical body also having a second longitudinally cylindrical internal bore and a second substantially closed lower end;

an upper plunger axially slideable within the second longitudinally cylindrical internal bore of the internal cylindrical body;

a first oil chamber formed between the internal cylindrical body and the first substantially closed lower end of the lifter body;

a first spring positioned between the internal cylindrical body and the lifter body, the first spring biasing the internal cylindrical body away from the lifter body;

a second oil chamber formed between the upper plunger and the second substantially closed lower end of the second internal cylindrical body;

a second spring positioned between the upper plunger and the internal cylindrical body, the second spring biasing upper plunger away from the internal cylindrical body;

a first oil flow path permitting the flow of oil into the first oil chamber through a first check valve;

a second oil flow path permitting the flow of oil into the second oil chamber through a second check valve;

an oil outlet in the lifter body adjacent the first substantially closed lower end allowing oil to escape from the first oil chamber;

an oil control recess in an outer surface of the internal cylindrical body, the oil control recess having an angled edge that functions to adjust the axial distance from the outer surface of the internal cylindrical body to the oil outlet when the internal cylindrical body is rotated with respect to the lifter body.

8. The adjustable hydraulic valve lifter of claim 7, further comprising a motor for rotating internal cylindrical body with respect to the lifter body between a closed position, wherein the outer surface of the internal cylindrical body covers the oil outlet, a first position wherein the outer surface of the internal cylindrical body initially does not cover the oil outlet, but does cover the oil outlet once the internal cylindrical body has moved axially a first distance, and a second position wherein the outer surface of the internal cylindrical body initially does not cover the oil outlet, but does cover the oil outlet once the internal cylindrical body has moved axially a second distance, the second distance being greater than the first distance.

9. The adjustable hydraulic valve lifter of claim 8, further comprising a pinion formed in an upper portion of the internal cylindrical body.

10. The adjustable hydraulic valve lifter of claim 9, further comprising a rack operably attached to the motor, the rack operably engaging the pinion of the internal cylindrical body, furthermore wherein the motor is a stepper motor operably functional to control the rotation of the internal cylindrical body through the rack and the pinion.

11. The adjustable hydraulic valve lifter of claim 8, wherein the angled edge of the oil control recess includes a plurality of steps, one of the plurality of steps corresponding with the first position and the second position.

12. The adjustable hydraulic valve lifter of claim 11, wherein the motor is a stepper motor.

13. The adjustable hydraulic valve lifter of claim 7, wherein the first oil flow path comprises:

a first annular oil passage recess around the lifter body;

a first oil flow aperture through the first annular oil passage recess of the lifter body;

a second annular oil passage recess of the internal cylindrical body, the first oil flow aperture being in fluid communication with the second annular oil passage recess; and an oil flow conduit connecting the second annular oil passage recess with the first oil chamber, wherein the first check valve is operably positioned across the oil flow conduit.

14. The adjustable hydraulic valve lifter of claim 13, wherein the second oil flow path comprises:

the first annular oil passage recess, the first oil flow aperture, and the second annular oil passage recess;

a second oil flow aperture through the second annular oil passage recess of the internal cylindrical body;

a third annular oil passage recess of the upper plunger, the second oil flow aperture being in fluid communication with the third annular oil passage recess;

a third oil flow aperture through the third annular oil passage recess of the upper plunger;

an oil reservoir within the upper plunger, the oil reservoir being in fluid communication with the third oil flow aperture; and an oil inlet aperture through the upper plunger to the second oil chamber, wherein the second check valve is operably positioned across the oil inlet aperture.

15. The adjustable hydraulic valve lifter of claim 7, further comprising a roller rotatably mounted on the lifter body adjacent the substantially closed lower end.

* * * * *